US007520399B2

(12) United States Patent
Lane et al.

(10) Patent No.: US 7,520,399 B2
(45) Date of Patent: Apr. 21, 2009

(54) INTERLOCKING RECTANGULAR CONTAINER

(75) Inventors: Michael T. Lane, Brooklyn, MI (US); Dan Weissmann, Simsbury, CT (US)

(73) Assignee: Amcor Limited, Victoria (AU)

( * ) Notice: Subject to any disclaimer, the term of this patent is extended or adjusted under 35 U.S.C. 154(b) by 0 days.

(21) Appl. No.: 11/476,444

(22) Filed: Jun. 28, 2006

(65) Prior Publication Data

US 2008/0000867 A1 Jan. 3, 2008

(51) Int. Cl.
*B65D 21/024* (2006.01)
*B65D 23/12* (2006.01)

(52) U.S. Cl. ..... 215/10; 215/381; 215/383; 206/509; 220/23.4; 220/675

(58) Field of Classification Search ..... 215/6, 215/10, 381–383; 220/23.4, 669, 675; 206/509, 206/504

See application file for complete search history.

(56) References Cited

U.S. PATENT DOCUMENTS 2,369,658 A * 2/1945 Burns ..... 428/161
4,308,955 A 1/1982 Schieser et al.
4,624,383 A * 11/1986 Moore ..... 220/23.4
4,656,840 A * 4/1987 Loofbourrow et al. ..... 62/530
5,002,199 A 3/1991 Frahm
5,133,469 A 7/1992 Mehta et al.
6,276,549 B1 * 8/2001 Fasci et al. ..... 220/23.4
6,588,612 B1 7/2003 Dorn et al.
6,857,530 B2 2/2005 Yourist
6,932,228 B1 8/2005 Darr et al.
2003/0221987 A1 * 12/2003 Trude ..... 206/508

* cited by examiner

*Primary Examiner*—Sue A Weaver
(74) *Attorney, Agent, or Firm*—Harness, Dickey & Pierce, P.L.C.

(57) ABSTRACT

A plastic container includes an upper portion having a mouth defining an opening into the container. A shoulder region extends from the upper portion. A sidewall portion extends from the shoulder region to a base portion. The base portion closes off an end of the container. The sidewall portion is defined in part by at least two vacuum panels formed therein. The vacuum panels are movable to accommodate vacuum forces generated within the container resulting from heating and cooling of its contents. The shoulder region and the base portion each define an interlocking structure suitable to achieve a nesting relationship with complementary mating surfaces of an adjacent container.

23 Claims, 9 Drawing Sheets

INTERLOCKING RECTANGULAR CONTAINER

TECHNICAL FIELD

This invention generally relates to plastic containers for retaining a commodity, and in particular a liquid commodity. More specifically, this invention relates to a rectangular plastic container having a sidewall portion that allows for significant absorption of vacuum pressures without unwanted deformation in other portions of the container, as well as structure that allows adjacent containers to interlock in a stable nested relationship.

BACKGROUND

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. Studies have indicated that the configureation and overall aesthetic appearance of a blow-molded plastic container can affect consumer purchasing decisions. For example, a dented, distorted or otherwise unaesthetically pleasing container may provide the reason for some consumers to purchase a different brand of product which is packaged in a more aesthetically pleasing fashion.

While a container in its as-designed configuration may provide an appealing appearance when it is initially removed from a blow-molding machine, many forces act subsequently on, and alter, the as-designed shape from the time it is blow-molded to the time it is placed on a store shelf. Plastic containers are particularly susceptible to distortion since they are continually being re-designed in an effort to reduce the amount of plastic required to make the container. While this strategy realizes a savings with respect to material costs, the reduction in the amount of plastic can decrease container rigidity and structural integrity.

Manufacturers currently supply PET containers for various liquid commodities, such as juice and isotonic beverages. Suppliers often fill these liquid products into the containers while the liquid product is at an elevated temperature, typically between 155° F.-205° F. (68° C.-96° C.) and usually at approximately 185° F. (85° C.). When packaged in this manner, the hot temperature of the liquid commodity sterilizes the container at the time of filling. The bottling industry refers to this process as hot filling, and the containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well.

For non-high acid content commodities, pasteurization and retort are the preferred sterilization processes. Pasteurization and retort both present an enormous challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 155° F. (approximately 70° C.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-380 mm Hg less than atmospheric pressure (i.e., 759 mm Hg−380 mm Hg). If not controlled or otherwise accommodated, these vacuum pressures result in deformation of the container, which leads to either an aesthetically unacceptable container or one that is unstable. Hot-fillable plastic containers must provide sufficient flexure to compensate for the changes of pressure and temperature, while maintaining structural integrity and aesthetic appearance. Typically, the industry accommodates vacuum related pressures with sidewall structures or vacuum panels formed within the sidewall of the container. Such vacuum panels generally distort inwardly under vacuum pressures in a controlled manner to eliminate undesirable deformation.

Filled containers are often packed in bulk such as on a pallet or bundle pack. In this way, it is generally desirable to group a large amount of containers together in a small area. Furthermore, it is also necessary to stabilize the containers on the pallet or bundle pack such that damage from shifting is minimized. In general, external forces are applied to sealed containers as they are packed and shipped. A bottom row of packed, filled containers may support several upper tiers of filled containers, and potentially, several upper boxes of filled containers. Therefore, it is important that the container have a top loading capability as well as lateral stability to prevent distortion from the intended container shape. Similarly, in some instances, a marketing advantage exists when containers are packaged in pairs.

Thus, there is a need for an improved lightweight rectangular container which can accommodate the vacuum pressures which result from hot filling, while also providing an interlock feature such that adjacent containers on a pallet or bundle pack, or packaged in pairs can remain stable such as during transport.

SUMMARY

Accordingly, this disclosure provides for a rectangular plastic container which maintains aesthetic and mechanical integrity during any subsequent handling after being hot-filled and cooled to ambient allowing for significant absorption of vacuum pressures without unwanted deformation in other portions of the container. In one example, the vacuum pressures are accommodated at vacuum panels formed in the sidewall of the container. An interlocking feature is also provided on the container allowing for the container to nest with complementary mating surfaces of adjacent containers. The interlocking feature is formed on an area of the container away from the vacuum panels. In this way, the container can accommodate distortion at the vacuum panels while substantially unaffecting the mating, interlocking feature between adjacent containers.

The present disclosure describes a plastic container having an upper portion including a mouth defining an opening into the container. A shoulder region extends from the upper portion. A sidewall portion extends from the shoulder region to a base portion. The base portion closes off an end of the container. The sidewall portion is defined in part by at least two vacuum panels formed therein. The vacuum panels are movable to accommodate vacuum forces generated within the container resulting from heating and cooling of its contents. The shoulder region and the base portion each define interlocking structures suitable to achieve a nesting relationship with complementary mating surfaces of adjacent containers.

Additional benefits and advantages of the present disclosure will become apparent to those skilled in the art to which the present disclosure relates from the subsequent description and the appended claims, taken in conjunction with the accompanying drawings.

DETAILED DESCRIPTION

The following description is merely exemplary in nature, and is in no way intended to limit the disclosure or its application or uses.

In a PET heat-set container, a combination of controlled deformation and vacuum resistance is required. This disclosure provides for a plastic container which enables its sidewall portion under typical hot-fill process conditions to deform and move easily while maintaining a rigid structure (i.e., against internal vacuum) in the remainder of the container. As an example, in a 64 fl. oz. (1891 cc) plastic container, the container typically should accommodate roughly 60 cc of volume displacement. In the present plastic container, the sidewall portion accommodates a significant portion of this requirement. Accordingly, the sidewall portion accounts for all noticeable distortion. The improved rigid construction of the remaining portions of the plastic container is easily able to accommodate the rest of this volume displacement without readily noticeable distortion. In the present plastic container, such remaining portions include a shoulder region and a base portion.

The container according to the present teachings provides interlocking structures formed at the shoulder region and the base portion. The interlocking structures allow the opposing surfaces of adjacent containers to achieve a nesting relationship resulting in a more stable positioning. In this way, a collection of containers such as in a bulk pallet, bundle pack, or packaged in pairs may achieve a stable collective footprint or unit. The interlocking structures between adjacent containers cooperate to resist unwanted movement of one container relative to an adjacent container during packaging and shipping operations.

Figure 1:
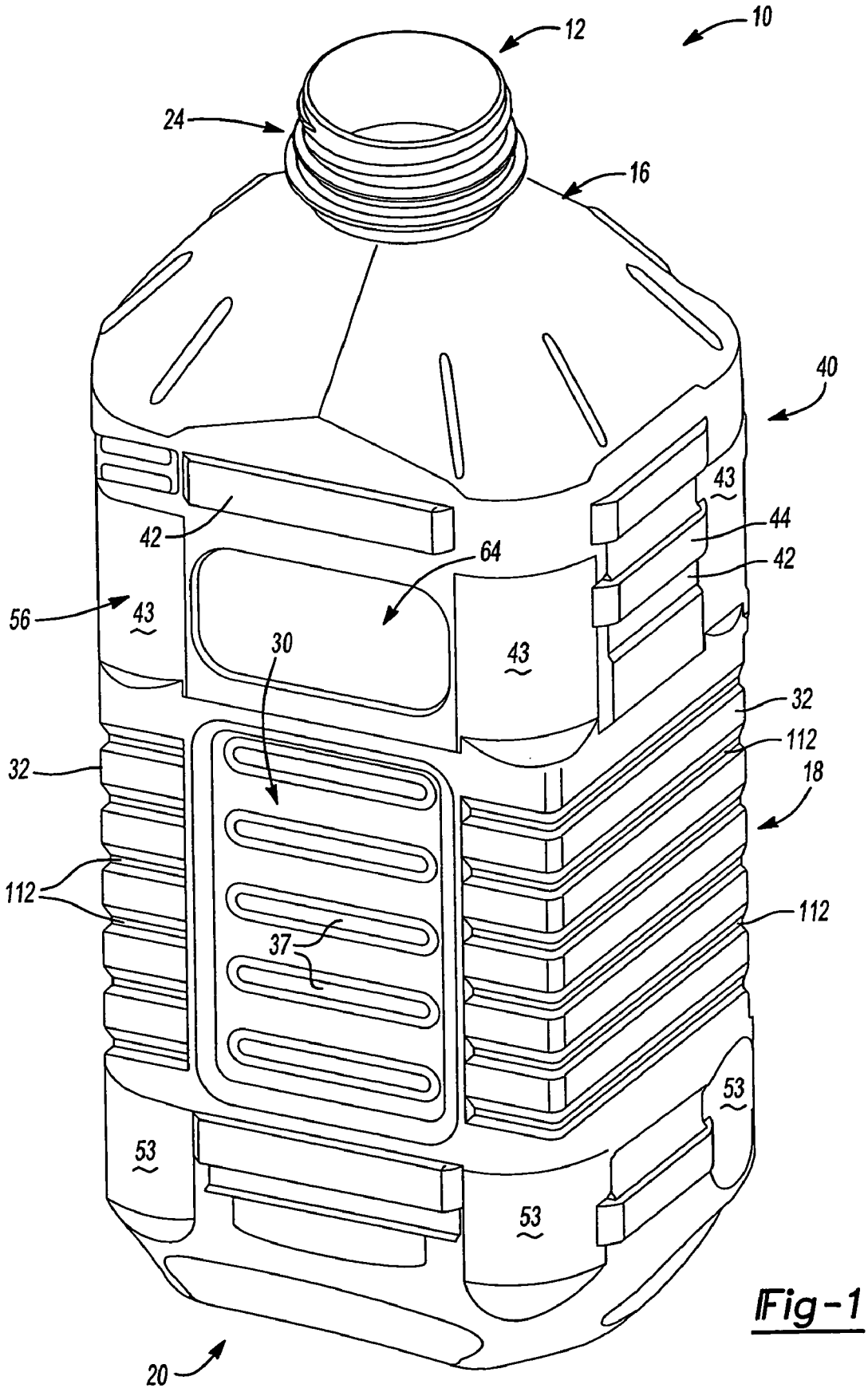
FIG. 1 is a perspective view of a plastic container constructed in accordance with the present teachings, the container as molded and empty.
Figure 2:
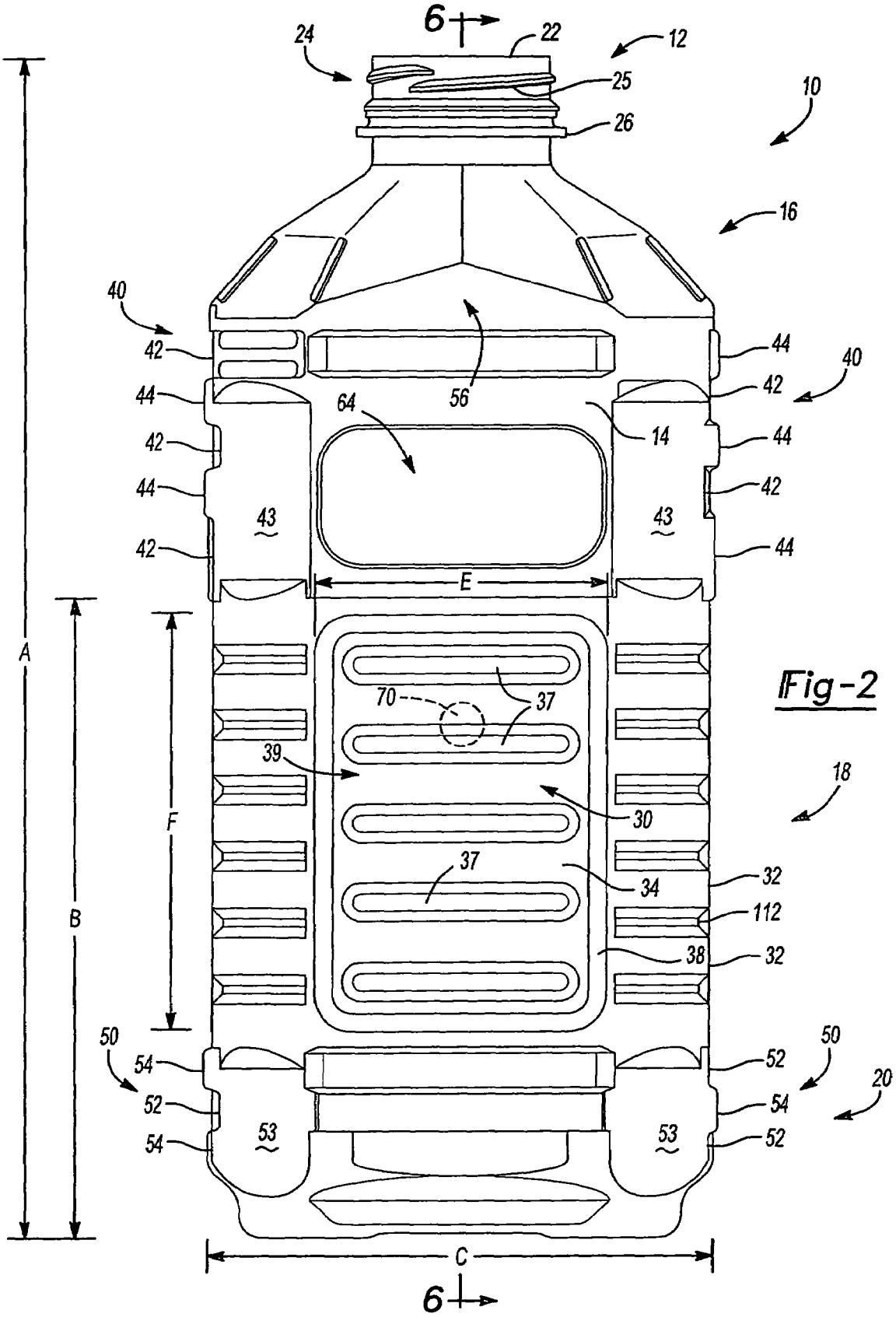
FIG. 2 is a front elevational view of the plastic container according to the present invention, the container as molded and empty.

FIGS. 1-7 show the present container. In the figures, reference number 10 designates a plastic, e.g. polyethylene terephthalate (PET), hot-fillable container. As shown in FIG. 2, the container 10 has an overall height A of about 10.45 inch (266.19 mm), and a sidewall and base portion height B of about 5.94 inch (151.37 mm). The height A is selected so that the container 10 fits on the shelves of a supermarket or store.

As shown in the figures, the container 10 is substantially rectangular in cross sectional shape including opposing longer sides 14 each having a width C of about 4.72 inch (120 mm), and opposing shorter, parting line sides 15 (FIGS. 4 and 5) each having a width D of about 3.68 inch (93.52 mm). The widths C and/or D are selected so that the container 10 can fit within the door shelf of a refrigerator. Said differently, as with typical prior art bottles, opposing longer sides 14 of the container 10 of the present disclosure are oriented at approximately 90 degree angles to the shorter, parting line sides 15 of the container 10 so as to form a generally rectangular cross section. In this particular embodiment, the container 10 has a volume capacity of about 64 fl. oz. (1891 cc). Those of ordinary skill in the art would appreciate that the following teachings of the present disclosure are applicable to other containers, such as round, triangular, hexagonal, octagonal or square shaped containers, which may have different dimensions and volume capacities. It is also contemplated that other modifications can be made depending on the specific application and environmental requirements.

As shown in FIGS. 1-5, the plastic container 10 includes a finish 12, a shoulder region 16, a sidewall portion 18 and a base portion 20. Those skilled in the art know and understand that a neck (not illustrated) may also be included having an extremely short height, that is, becoming a short extension from the finish 12, or an elongated height, extending between the finish 12 and the shoulder region 16. The plastic container 10 has been designed to retain a commodity during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal-the container 10 with a closure (not illustrated) before cooling. As the sealed container 10 cools, a slight vacuum, or negative pressure, forms inside causing the container 10, in particular, the sidewall portion 18, as will be described, to change shape. In addition, the plastic container 10 may be suitable for other high-temperature pasteurization or retort filling processes, or other thermal processes as well.

The plastic container 10 is a blow molded, biaxially oriented container with a unitary construction from a single or multi-layer material. A well-known stretch-molding, heat-setting process for making the hot-fillable one-piece plastic container 10 generally involves the manufacture of a preform (not illustrated) of a polyester material, such as polyethylene terephthalate (PET), having a shape well known to those skilled in the art similar to a test-tube with a generally cylindrical cross section and a length typically approximately fifty percent (50%) that of the resultant container height. In one example, a machine (not illustrated) places the preform heated to a temperature between approximately 190° F. to 250° F. (approximately 88° C. to 121° C.) into a mold cavity (not illustrated) having a shape similar to the plastic container 10. The mold cavity may be heated to a temperature between approximately 250° F. to 350° F. (approximately 121° C. to 177° C.). A stretch rod apparatus (not illustrated) stretches or extends the heated preform within the mold cavity to a length approximately that of the container 10 thereby molecularly orienting the polyester material in an axial direction generally corresponding with a central longitudinal axis 28 (FIGS. 6 and 7) of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container 10. Typically, material within the finish 12 and a sub-portion of the base portion 20 are not substantially molecularly oriented. The pressurized air holds the mostly biaxial molecularly oriented polyester material against the mold cavity for a period of approximately two (2) to five (5) seconds before removal of the container 10 from the mold cavity. This process is known as heat setting and results in a heat-resistant container suitable for filling with a product at high temperatures.

Alternatively, other manufacturing methods, such as for example, extrusion blow molding, one step injection stretch blow molding and injection blow molding, using other conventional materials including, for example, high density polyethylene, polypropylene, polyethylene naphthalate (PEN), a PET/PEN blend or copolymer, and various multilayer structures may be suitable for the manufacture of plastic container 10. Those having ordinary skill in the art will readily know and understand plastic container manufacturing method alternatives.

The finish 12 of the plastic container 10 includes a portion defining an aperture or mouth 22, a threaded region 24 having threads 25, and a support ring 26. The aperture 22 allows the plastic container 10 to receive a commodity while the threaded region 24 provides a means for attachment of a similarly threaded closure or cap (not illustrated). Alternatives may include other suitable devices that engage the finish 12 of the plastic container 10. Accordingly, the closure or cap (not illustrated) engages the finish 12 to preferably provide a hermetical seal of the plastic container 10. The closure or cap (not illustrated) is preferably of a plastic or metal material conventional to the closure industry and suitable for subsequent thermal processing, including high temperature pasteurization and retort. The support ring 26 may be used to carry or orient the preform (the precursor to the plastic container 10) (not illustrated) through and at various stages of manufacture. For example, the preform may be carried by the support ring 26, the support ring 26 may be used to aid in positioning the preform in the mold, or an end consumer may use the support ring 26 to carry the plastic container 10 once manufactured.

Integrally formed with the finish 12 and extending downward therefrom is the shoulder region 16. The shoulder region 16 merges into and provides a transition between the finish 12 and the sidewall portion 18. The sidewall portion 18 extends downward from the shoulder region 16 to the base portion 20. The specific construction of the sidewall portion 18 of the heat-set container 10 allows the shoulder region 16 and the base portion 20 to not necessarily require additional vacuum panels, and therefore, the shoulder region 16 and the base portion 20 are capable of providing increased rigidity and structural support to the container 10. The base portion 20 functions to close off the bottom portion of the plastic container 10 and, together with the finish 12, the shoulder region 16, and the sidewall portion 18, to retain the commodity.

The plastic container 10 is preferably heat-set according to the above-mentioned process or other conventional heat-set processes. To accommodate vacuum forces, the sidewall portion 18 may include vacuum panels 30 formed therein. As illustrated in the figures, vacuum panels 30 may be generally rectangular in shape and are formed in the opposing longer sides 14 of the container 10. It is appreciated that the vacuum panels may define other geometrical configurations. Accordingly, the container 10 illustrated in the figures has two (2) vacuum panels 30. The inventors however equally contemplate that more than two (2) vacuum panels 30, such as four (4), can be provided. That is, that vacuum panels 30 may also be formed in opposing shorter, parting line sides 15 of the container 10 as well. Surrounding vacuum panels 30 is land 32. Land 32 provides structural support and rigidity to the sidewall portion 18 of the container 10.

Vacuum panels 30 include an underlying surface 34 and a series of ribs 37. Ribs 37 are generally arcuately shaped, arranged horizontally throughout the entire height, from top to bottom, of vacuum panels 30, and generally spaced equidistantly apart from one another. A person of ordinary skill in the art will readily understand that other geometric designs, arrangements and quantities are feasible. Such alternative geometrical designs, arrangements and quantities may increase the amount of absorption vacuum panels 30 can accommodate. Accordingly, the exact shape of ribs 37 can vary greatly depending on various design criteria.

Additionally, the wall thickness of vacuum panels 30 must be thin enough to allow vacuum panels 30 to be flexible and function properly. With this in mind, those skilled in the art of container manufacture realize that the wall thickness of the container 10 may vary considerably depending where a technician takes a measurement within the container 10.

Vacuum-panels 30 may also include a perimeter edge 38. The perimeter edge 38 defines the transition between the land 32 and the underlying surface 34 of vacuum panels 30. The perimeter edge 38 provides strength to the transition between the land 32 and the underlying surface 34. The resulting localized strength increases the resistance to creasing and denting in the sidewall portion 18.

Figure 6:
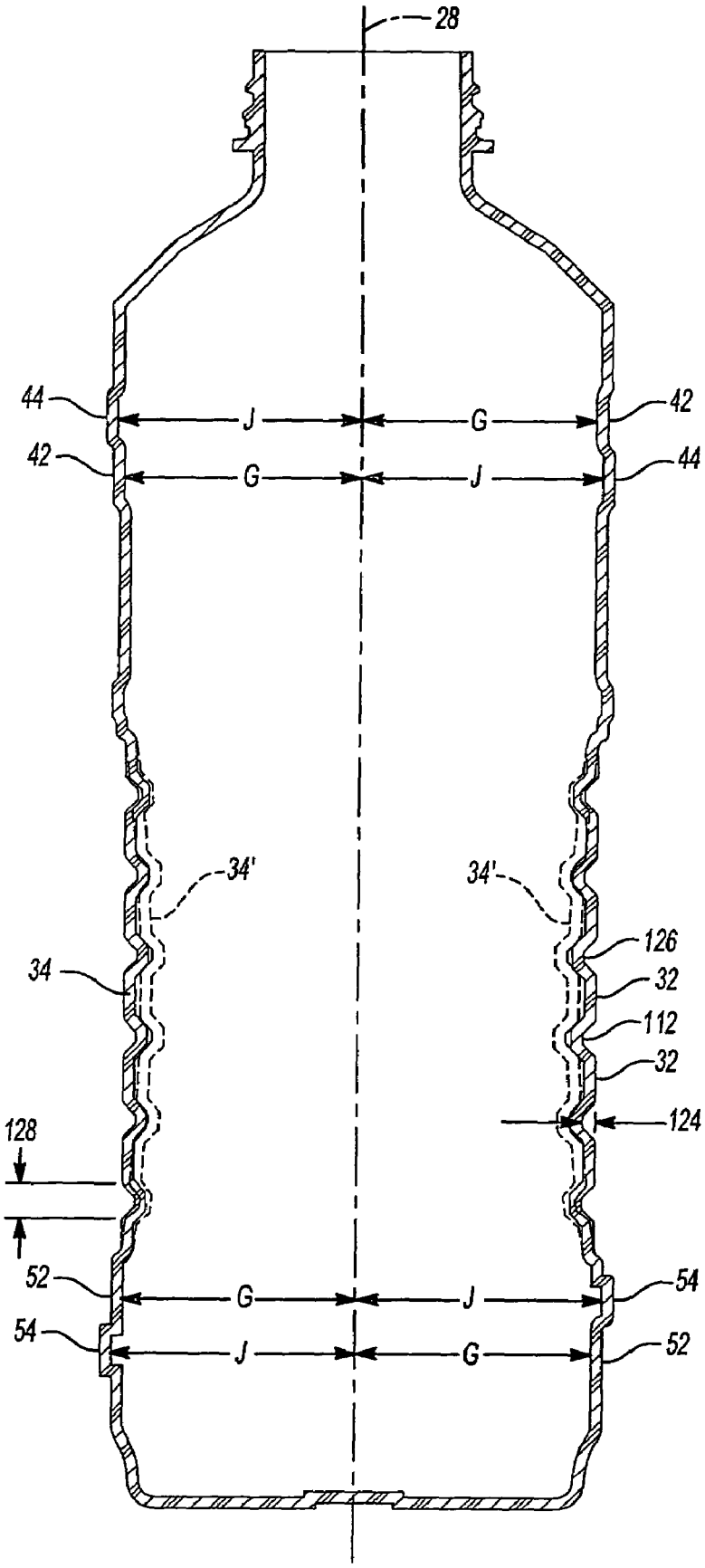
FIG. 6 is a cross-sectional view of the plastic container, taken generally along line 6-6 of FIG. 2.
Figure 7:
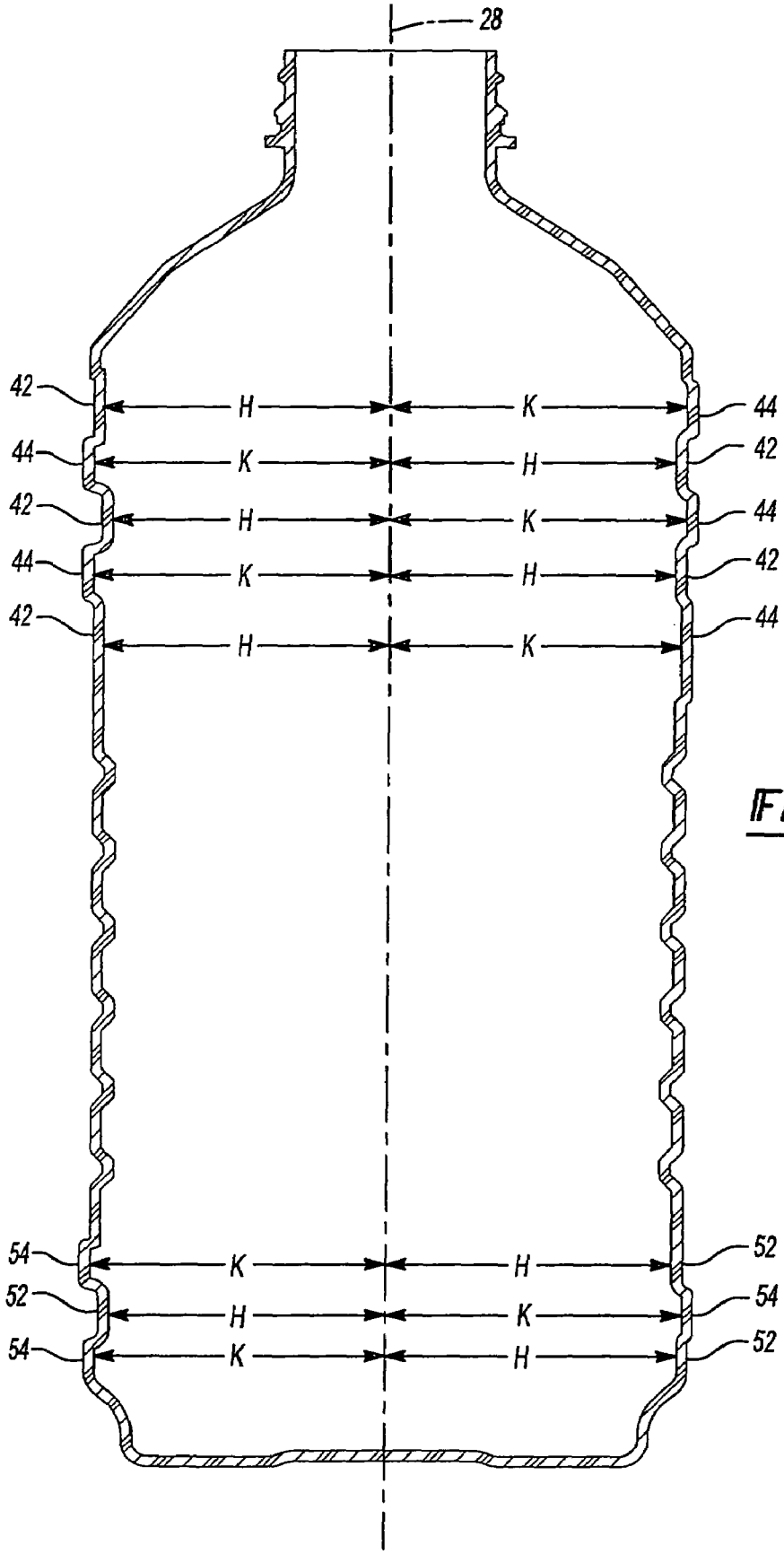
FIG. 7 is a cross-sectional view of the plastic container, taken generally along line 7-7 of FIG. 4.

Upon filling, capping, sealing and cooling, as illustrated in FIG. 6 in phantom, the perimeter edge 38 acts as a hinge that aids in the allowance of the underlying surface 34 of vacuum panels 30 to be pulled radially inward, toward the central longitudinal axis 28 of the container 10, displacing volume, as a result of vacuum forces. In this position, the underlying surface 34 of vacuum panels 30, in cross section, illustrated in FIG. 6 in phantom, forms a generally concave surface 34'. The greater the inward radial movement between underlying surfaces 34 and 34', the greater the achievable displacement of volume.

The amount of volume which vacuum panels 30 of the sidewall portion 18 displaces is also dependant on the projected surface area of vacuum panels 30 of the sidewall portion 18 as compared to the projected total surface area of the sidewall portion 18. Accordingly, the projected surface area of vacuum panels 30 (two (2) vacuum panels) of the sidewall portion 18 is required to be 20%, and preferably greater than approximately 25%, of the total projected surface area of the sidewall portion 18. The generally rectangular configuration of the container 10 creates a large surface area on opposing longer sides 14 of the sidewall portion 18, thereby promoting the use of large vacuum panels. The inventors have taken advantage of this large surface area by placing large vacuum panels 30 in this area. To maximize vacuum absorption, the contour of vacuum panels 30 substantially mimics the contour of the sidewall portion 18. Accordingly, as illustrated in FIG. 2, this results in vacuum panels 30 having a width E and a height F. In one example, for the container 10 having a nominal capacity of approximately 64 fl. oz. (1891 cc), the width E is about 2.36 inch (60 mm) while the height F is about 3.54 inch (90 mm).

A label panel area 39 is defined at the sidewall portion 18. The label panel area 39 may generally overlay the vacuum panels 30. As is commonly known and understood by container manufacturers skilled in the art, a label may be applied to the sidewall portion 18 at the label panel area 39 using methods that are well known to those skilled in the art, including shrink-wrap labeling and adhesive methods. As applied, the label may extend around the entire body or be limited to a single side of the sidewall portion 18.

The sidewall portion 18 may further include a series of horizontal ribs 112. Horizontal ribs 112 circumscribe the perimeter of the sidewall portion 18 of the container 10 and are interrupted at the vacuum panels 30. Horizontal ribs 112 extend continuously in a longitudinal direction across the label panel area 39 from the shoulder region 16 to the base portion 20. Defined between each adjacent horizontal rib 112 is land 32. Again, land 32 provides additional structural support and rigidity to the sidewall portion 18 of the container 10.

Horizontal ribs 112 have an overall depth dimension 124 (FIG. 6) measured between a lower most point 126 and land 32. The overall depth dimension 124 is approximately equal to a width dimension 128 of horizontal ribs 112. Generally, the overall depth dimension 124 and the width dimension 128 for the container 10 having a nominal capacity of approximately 64 fl. oz. (1891 cc) is between approximately 0.039 inch (1 mm) and approximately 0.157 inch (4 mm). As illustrated in the figures, in one example, the overall depth dimension 124 and the width dimension 128 are fairly consistent among all of the horizontal ribs 112. However, in alternate examples, it is contemplated that the overall depth dimension 124 and the width dimension 128 of horizontal ribs 112 will vary between opposing sides or all sides of the container 10, thus forming a series of modulating horizontal ribs. While the above-described geometry of horizontal ribs 112 is one example, a person of ordinary skill in the art will readily understand that other geometrical designs and arrangements are feasible. Accordingly, the exact shape, number and orientation of horizontal ribs 112 can vary depending on various design criteria.

As illustrated in FIGS. 1-5, and briefly mentioned above, the sidewall portion 18 merges into and is unitarily connected to the shoulder region 16 and the base portion 20. The unique construction of the shoulder region 16 and the base portion 20 of the container 10 allows for adjacent containers to interlock in a stable, nested relationship. Accordingly, the shoulder region 16 of the container 10 includes an interlocking structure 40 in the form of depressions or inset portions 42, and protrusions or outset portions 44 formed thereon, and support surfaces 43. Similarly, the base portion 20 of the container 10 includes an interlocking structure 50 in the form of depressions or inset portions 52, and protrusions or outset portions 54 formed thereon, and support surfaces 53.

Figure 3:
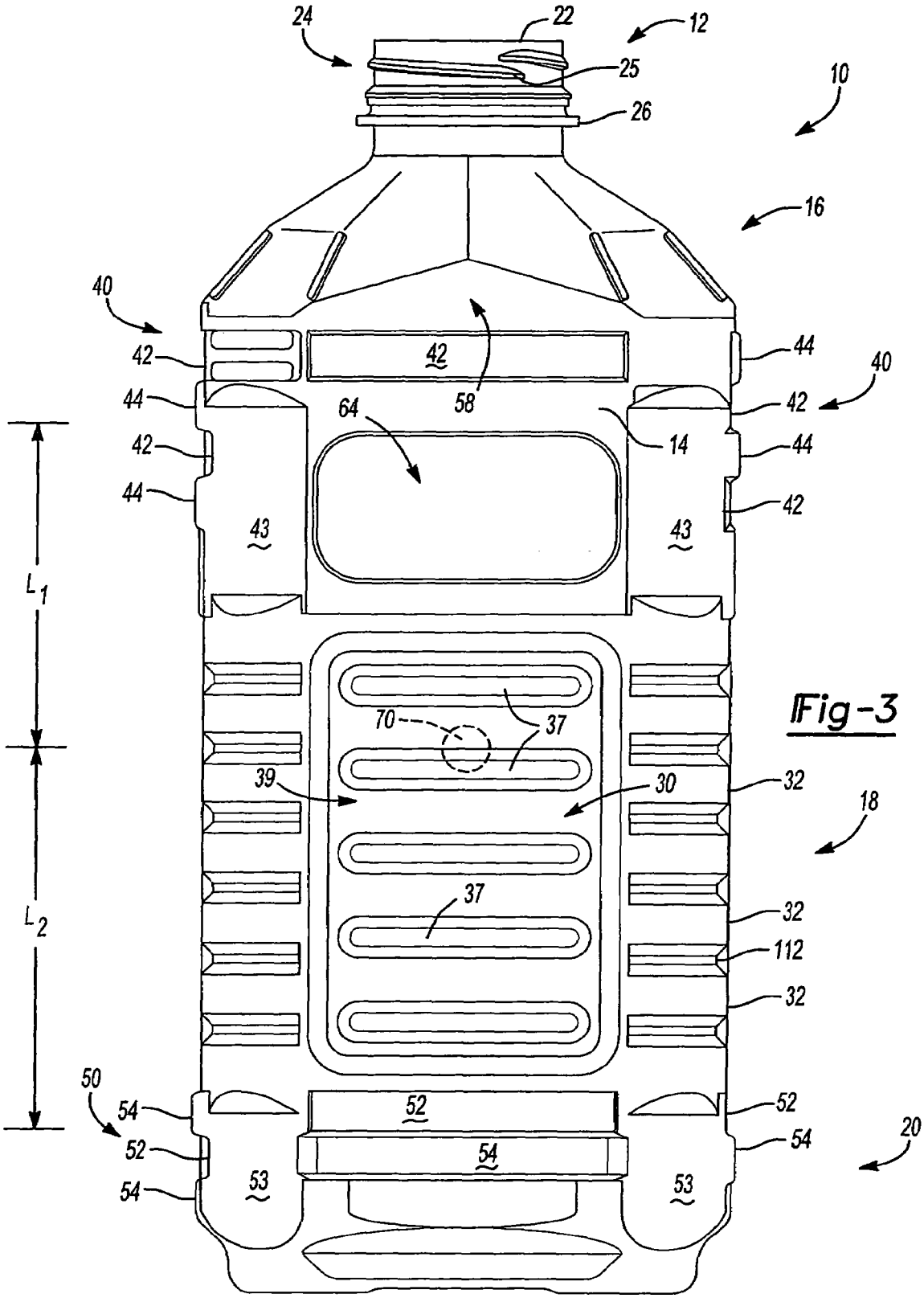
FIG. 3 is a rear elevational view of the plastic container of FIG. 1.
Figure 4:
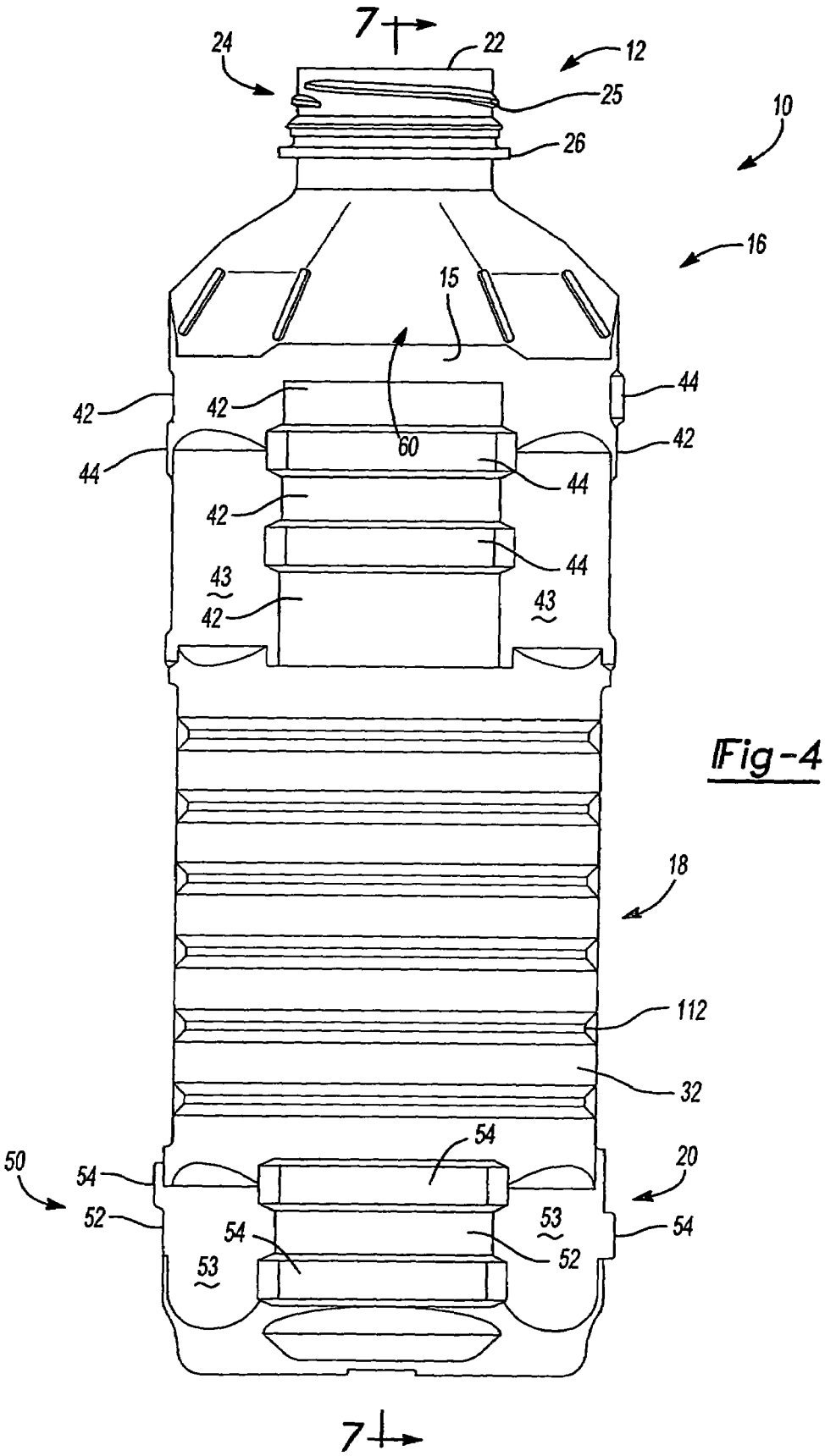
FIG. 4 is a right side view of the plastic container of FIG. 1.
Figure 5:
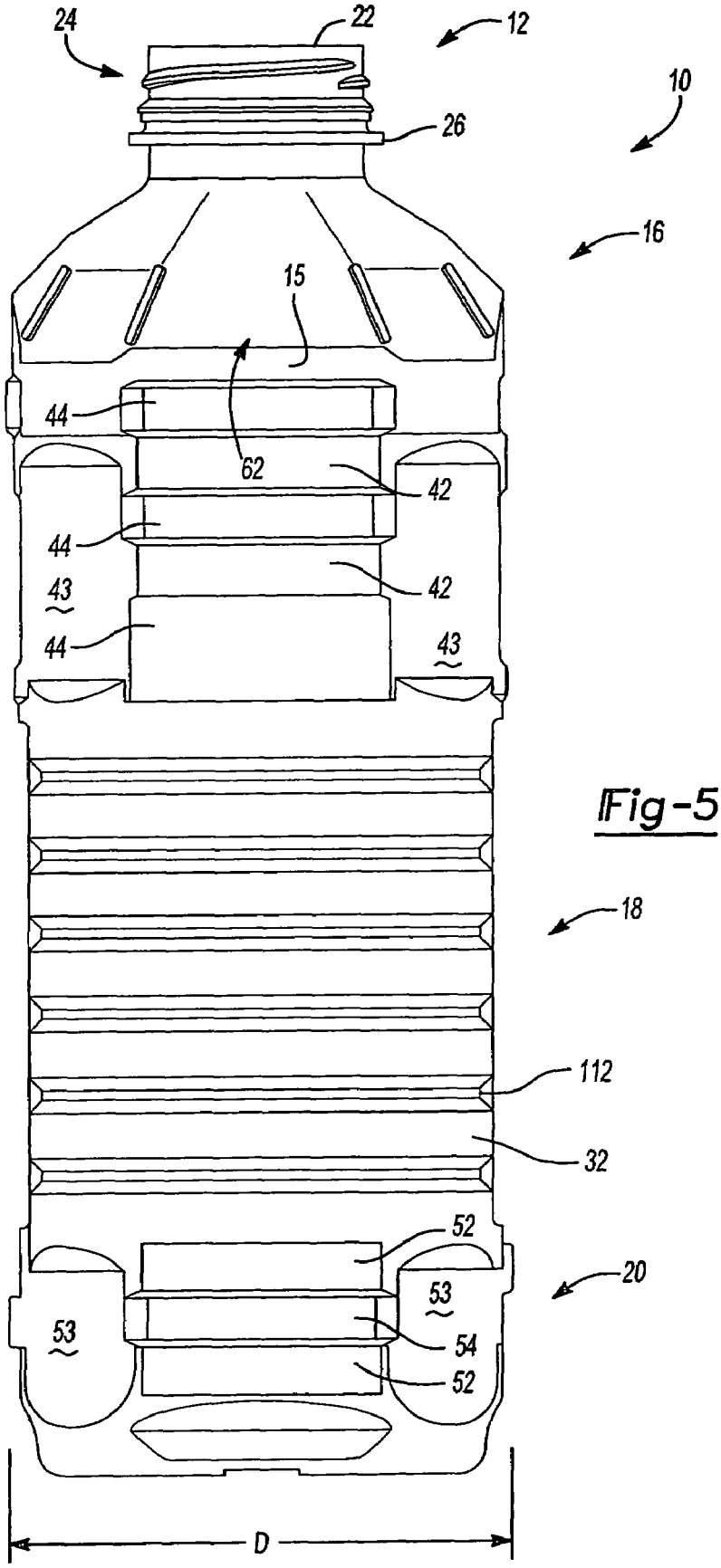
FIG. 5 is a left side view of the plastic container of FIG. 1.

For reference purposes, the container 10 will be hereinafter assigned unique sides. As illustrated in FIG. 2, one of the opposing longer sides 14 of the container 10 will be referred to as front face 56. As illustrated in FIG. 3, the other of the opposing longer sides 14 of the container 10 will be referred to as rear face 58. One of the shorter, parting line sides 15 of the container 10, as illustrated in FIG. 4, will be referred to as right face 60. The other of the shorter, parting line sides 15 of the container 10, as illustrated in FIG. 5, will be referred to as left face 62.

To accommodate top load forces, provide enhanced stiffening strength capabilities and stability, and to facilitate a robust nesting, mating and interlocking action between adjacent containers, the inset and outset portions 42, 52 and 44, 54, and support surfaces 43 and 53 are relatively pronounced and distinctive. In this regard, support surfaces 43 and 53 may be any structure which provides some degree of geometric differentiation inward from the sidewall portion 18, thereby providing enhanced stiffening strength capabilities to the interlocking structures 40 and 50, such that interlocking structures 40 and 50 are not adversely affected by associated vacuum forces.

Particularly for rectangular shaped hot-filled containers, vacuum forces tend to exert the greatest amount of force and/or stress at, or near, the approximate center of gravity of the container, especially at the opposing longer sides of the rectangular container. Thus, it is advantageous to position vacuum panels at, or near, the approximate center of gravity of the container in order to accommodate a majority of the vacuum forces. Accordingly, as illustrated in FIGS. 2 and 3, the approximate center of gravity, designated as circle 70, of container 10 is found within vacuum panels 30. Additionally, as stated earlier, it is further advantageous to locate interlocking structures 40 and 50 a distance away from the approximate center of gravity 70 of the container 10 such that interlocking structures 40 and 50 are not distorted or adversely affected by the vacuum forces acting on the container 10.

In one example, as illustrated in FIG. 3, interlocking structure 40, positioned on opposing longer sides 14, is located a distance $L_1$, approximately 3 inch (76.2 mm), above the approximate center of gravity 70 of the container 10. The distance $L_1$ may represent from about 20% to about 40% of the overall height A of the container 10, and more preferably about 25% to about 35%. The distance $L_1$ may further represent from about 50% to about 70% of the width C of opposing longer sides 14 of the container 10, and more preferably about 55% to about 65%.

Similarly, in one example, as illustrated in FIG. 3, interlocking structure 50, positioned on opposing longer sides 14, is located a distance $L_2$, approximately 3.35 inch (85.1 mm), below the approximate center of gravity 70 of the container 10. The distance $L_2$ may represent from about 20% to about 40% of the overall height A of the container 10, and more preferably about 25% to about 35%. The distance $L_2$ may further represent from about 60% to about 80% of the width C of opposing longer sides 14 of the container 10, and more preferably about 65% to 75%.

The spatial relationship of the inset portions 42 and 52 will now be described. With reference to FIG. 6, in one example, the inset portions 42 and 52 defined on the front and rear faces 56 and 58, respectively, extend radially outward from the central longitudinal axis 28 a distance G measured about 1.69 inch (42.95 mm). Similarly, with reference to FIG. 7, in one example, the inset portions 42 and 52 defined on the right and left faces 60 and 62, respectively, extend radially outward from the central longitudinal axis 28 a distance H measured about 2.18 inch (55.32 mm).

Figure 8:
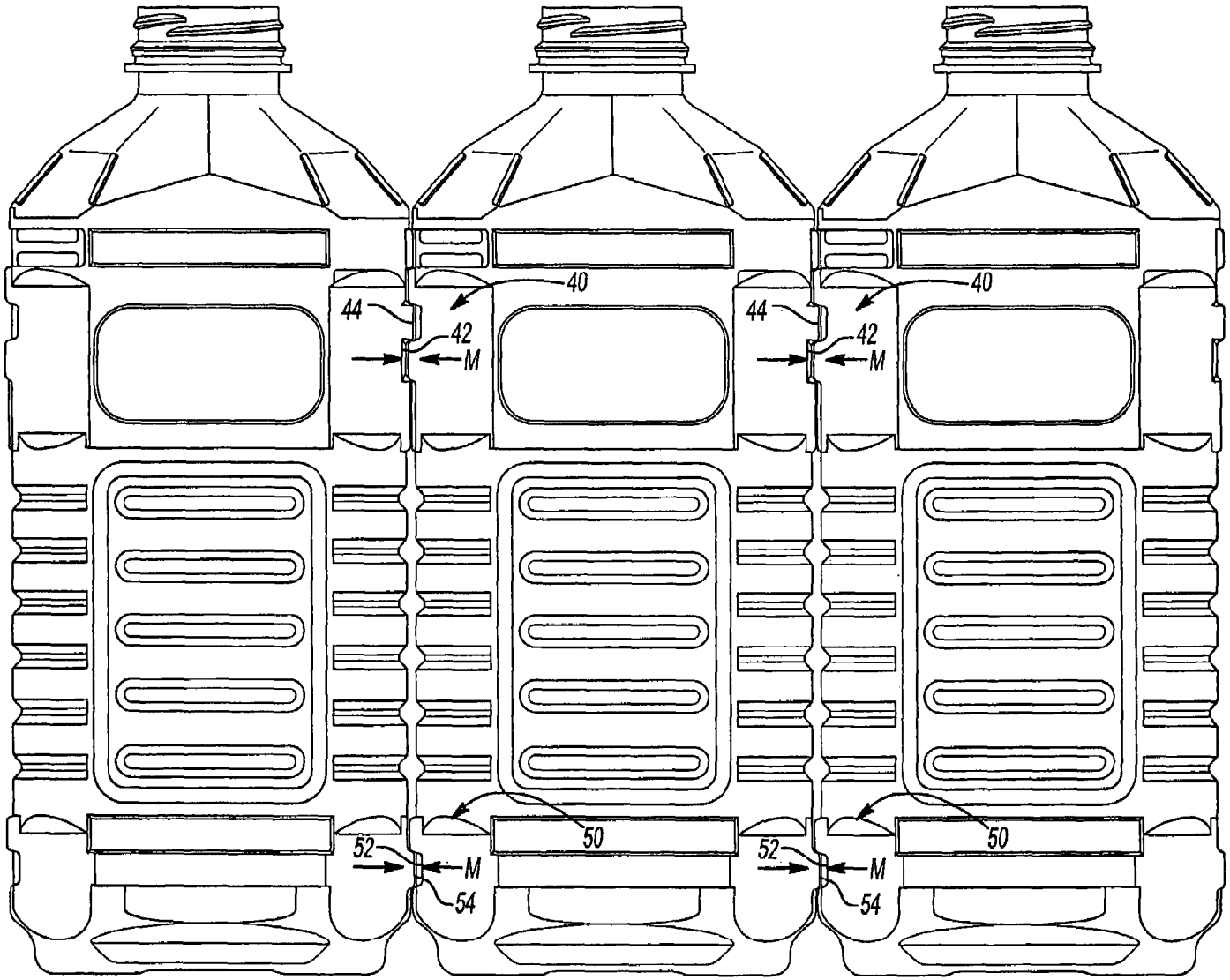
FIG. 8 is a front elevational view of a series of containers shown in an interlocked position according to the present invention.
Figure 9:
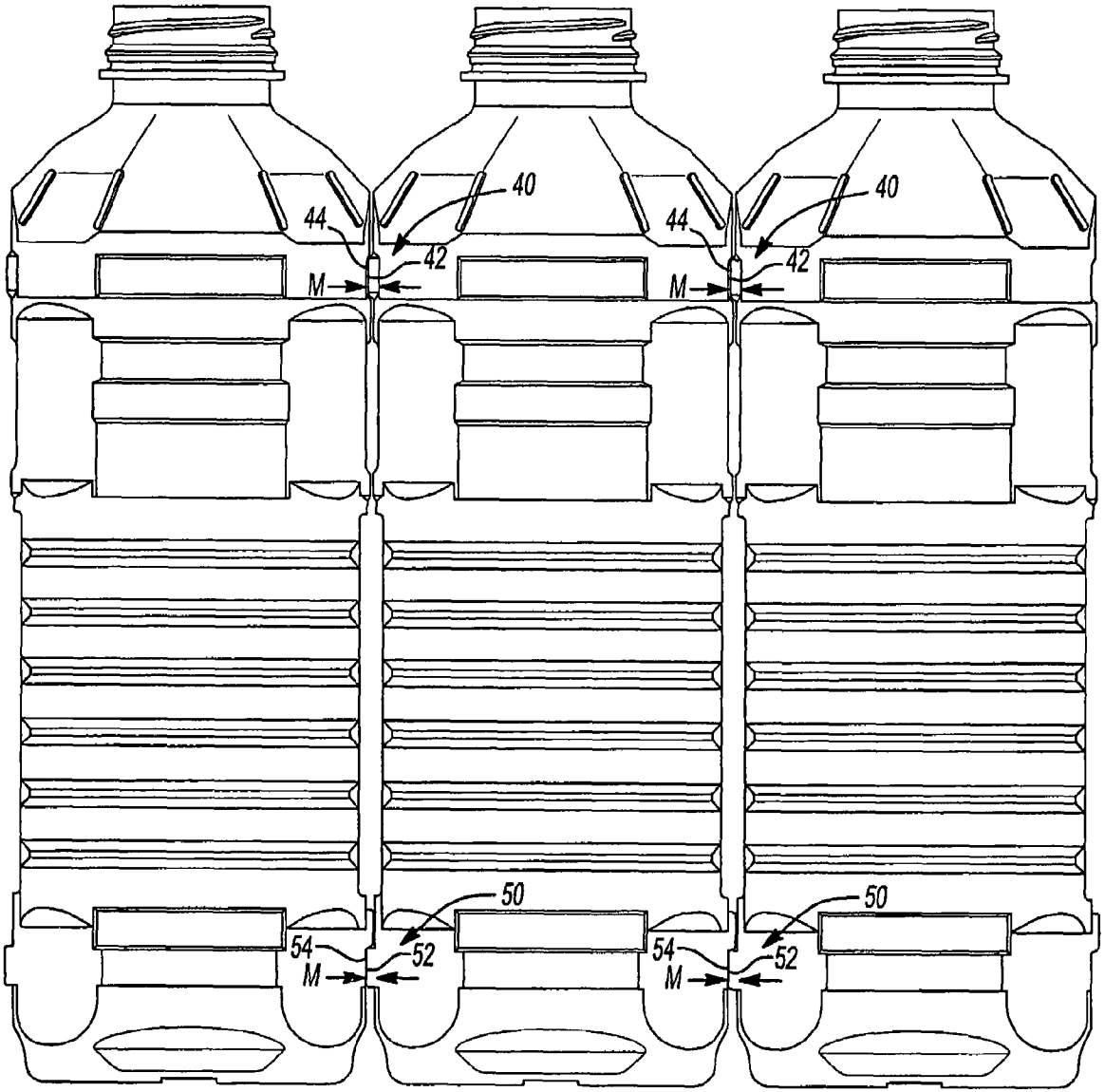
FIG. 9 is a side elevational view of a series of containers shown in an interlocked position according to the present invention.

The spatial relationship of the outset portions 44 and 54 will now be described. With reference to FIG. 6, in one example, the outset portions 44 and 54 defined on the front and rear faces 56 and 58, respectively, extend radially outward from the central longitudinal axis 28 a distance J measured about 1.81 inch (45.95 mm). Similarly, with reference to FIG. 7, in one example, the outset portions 44 and 54 defined on the right and left faces 60 and 62, respectively, extend radially outward from the central longitudinal axis 28 a distance K measured about 2.26 inch (57.32 mm). Accordingly, as a result, with reference to FIGS. 8 and 9, the respective outset portions 44 and 54 interfit, interlock and mate in a nested relationship with the respective inset portions 42 and 52 at a depth dimension M measured approximately 0.04 inch (1 mm) to approximately 0.12 inch (3 mm). Additionally, in one example, the dimension of the inset portions 42 and 52 is no more than approximately one-third (⅓) of the width dimension of the inset portions 42 and 52. The above and previously mentioned dimensions were taken from a typical 64 fl. oz. (1891 cc) hot fillable container. It is contemplated that comparable dimensions are attainable for containers of varying shapes and sizes.

The unique construction of the shoulder region 16 of the container 10 not only provides increased rigidity and stability to the container 10, but also provides additional support to a consumer when the consumer grasps the container 10 in this area of the shoulder region 16. A grip area 64 formed on the front and rear faces 56 and 58 has a height, width and depth that are dimensioned and structured to provide support for a variety of hand sizes. The grip area 64 is adapted to support the fingers and thumb of a person of average size. However, the support feature of the grip area 64 is not limited for use by a person having average size hands. By selecting and structuring the height, width and depth of the grip area 64, user comfort is enhanced, good support is achieved and this support feature is capable of being utilized by persons having a wide range of hand sizes. Moreover, the dimensioning and positioning of the grip area 64, and thus the support feature, facilitates holding, carrying and pouring of contents from the container 10. Additionally, support surfaces 43 offer a narrower hand entry point thereby enhancing a natural hand grip area.

The unique construction of the interlocking structures 40 and 50, and the support surfaces 43 and 53 provide added structure, support and strength to the container 10 as a whole. This added structure, support and strength enhances the top load strength capabilities of the container 10 by aiding in transferring top load forces, thereby preventing creasing, buckling, denting and deforming of the container 10 when subjected to top load forces. This unique construction and geometry also enables inherently thicker walls providing better rigidity, lightweighting, manufacturing ease and material consistency. Furthermore, this added structure, support and strength, resulting from the unique construction of the interlocking structures 40 and 50, the support surfaces 43 and 53, location of the vacuum panels 30, and location of the interlocking structures 40 and 50 in relation to the approximate center of gravity 70, minimizes movement, bowing and sagging of the container 10 at the interlocking structures 40 and 50 during fill, seal and cool down procedure. Thus, contrary to vacuum panels 30 formed in the sidewall portion 18, the shoulder region 16 and the base portion 20 maintain their relative stiffness throughout the fill, seal and cool down procedure assuring the integrity of the interlock feature between complementary mating surfaces of adjacent containers. Accordingly, the distance from the central longitudinal axis 28 of the container 10 to the respective inset and outset portions 42, 52 and 44, 54 is fairly consistent throughout the entire longitudinal length of the shoulder region 16 and the base portion 20, and this distance is generally maintained throughout the fill, seal and cool down procedure.

While the above description constitutes the present disclosure, it will be appreciated that the disclosure is susceptible to modification, variation and change without departing from the proper scope and fair meaning of the accompanying claims. For example, while the interlocking structure has been illustrated as cooperating longitudinal ribs, the interlocking structure may be formed as different geometries. For example, it is contemplated that annular knobs may be formed for nesting in respective annular depressions. Similarly, other complementary geometries may be defined to attain an interfitting, interlocking, nesting, mating relationship. Such geometries may include rectangles, triangles, diamonds, hexagons, octagons and others to name a few.

What is claimed is:

1. A plastic container comprising:

an upper portion having a mouth defining an opening into said container;

a shoulder region extending from said upper portion;

a sidewall portion extending from said shoulder region to a base portion, said base portion closing off an end of said container, said sidewall portion defined in part by at least two vacuum panels formed therein, said vacuum panels located approximate to a center of gravity of said container and being movable to accommodate vacuum forces generated within the container resulting from heating and cooling of its contents; and wherein said shoulder region and said base portion each define an interlocking structure suitable to achieve a nesting relationship with complementary mating surfaces of an adjacent container.

2. The container of claim 1 wherein each of said shoulder region, said sidewall portion and said base portion further define a first pair of opposing walls and a second pair of opposing walls.

3. The container of claim 2 wherein said shoulder region comprises a generally rectangular horizontal cross section.

4. The container of claim 2 wherein said interlocking structure includes at least one inset portion defined on one of said first pair of opposing walls of said shoulder region and at least one outset portion defined on the other of said first pair of opposing walls of said shoulder region.

5. The container of claim 4 wherein said at least one inset portion of said shoulder region is substantially coplanar to at least one outset portion of a shoulder region of said adjacent container.

6. The container of claim 4 wherein said interlocking structure further includes at least one inset portion defined on one of said first pair of opposing walls of said base portion and at least one outset portion defined on the other of said first pair of opposing walls of said base portion.

7. The container of claim 6 wherein said at least one inset portion of said shoulder region of said container is adapted to nest into at least one outset portion of a shoulder region of said adjacent container.

8. The container of claim 7 wherein said at least one inset portion of said base portion of said container is adapted to nest into at least one outset portion of a base portion of said adjacent container.

9. The container of claim 6 wherein said first pair of opposing walls are longer than said second pair of opposing walls and wherein at least two inset portions are defined on one of said second pair of opposing walls of said shoulder region and at least two outset portions are defined on the other of said second pair of opposing walls of said shoulder region.

10. The container of claim 9 wherein said sidewall portion includes two generally rectangular shaped vacuum panels, one formed in each of said opposing longer walls.

11. The container of claim 9 wherein said sidewall portion further defines a label panel area.

12. The container of claim 6 wherein said shoulder region interlocking structure is located approximately 20% to approximately 40% of an overall height of said container above said center of gravity of said container and said base portion interlocking structure is located approximately 20% to approximately 40% of said overall height of said container below said center of gravity of said container.

13. A plastic container comprising:

an upper portion having a mouth defining an opening into said container;

a shoulder region extending from said upper portion and defined in part by support surfaces;

a sidewall portion being movable to accommodate vacuum forces generated within the container resulting from heating and cooling of its contents extending from said shoulder region to a base portion, said base portion closing off an end of said container and defined in part by support surfaces, said shoulder region support surfaces and said base portion support surfaces are rigid and geometrically differentiated inward from said sidewall portion; and interlocking structure defined on at least one of said shoulder region and said base portion suitable to achieve a nesting relationship with complementary mating surfaces of an adjacent container.

14. The plastic container of claim 13 wherein said interlocking structure is defined at a horizontally offset location relative to a center of gravity of the container.

15. The plastic container of claim 14 wherein each of said shoulder region, said sidewall portion and said base portion further define a first pair of opposing walls and a second pair of opposing walls.

16. The plastic container of claim 15 wherein said interlocking structure includes at least one inset portion defined on one of said first pair of opposing walls of said shoulder region and at least one outset portion defined on the other of said first pair of opposing walls of said shoulder region.

17. The plastic container of claim 16 wherein said interlocking structure further includes at least one inset portion defined on one of said first pair of opposing walls of said base portion and at least one outset portion defined on the other of said first pair of opposing walls of said base portion.

18. The plastic container of claim 17 wherein said at least one inset portion of said shoulder region of said container is adapted to nest into at least one outset portion of a shoulder region of said adjacent container.

19. The plastic container of claim 18 wherein said at least one inset portion of said base portion of said container is adapted to nest into at least one outset portion of a base portion of said adjacent container.

20. The plastic container of claim 19 wherein said at least one inset portion of said shoulder region is substantially coplanar to at least one outset portion of a shoulder region of said adjacent container.

21. The plastic container of claim 20 wherein said first pair of opposing walls are longer than said second pair of opposing walls and wherein at least two inset portions are defined on one of said second pair of opposing walls of said shoulder region and at least two outset portions are defined on the other of said second pair of opposing walls of said shoulder region.

22. The plastic container of claim 21 wherein said sidewall portion includes two generally rectangular shaped vacuum panels, one formed in each of said opposing longer walls of said sidewall portion, said vacuum panels located approximate to said center of gravity of said container and being movable to accommodate vacuum forces generated within the container resulting from heating and cooling of its contents.

23. A plastic container comprising:

an upper portion having a mouth defining an opening into said container;

a shoulder region extending from said upper portion and defined in part by support surfaces;

a sidewall portion extending from said shoulder region to a base portion, said base portion closing off an end of said container and defined in part by support surfaces, said shoulder region support surfaces and said base portion support surfaces are geometrically differentiated inward from said sidewall portion; and interlocking structure defined at a horizontally offset location relative to a center of gravity of the container on at least one of said shoulder region and said base portion suitable to achieve a nesting relationship with complementary mating surfaces of an adjacent container; wherein said shoulder region interlocking structure is located approximately 20% to approximately 40% of an overall height of said container above said center of gravity of said container and said base portion interlocking structure is located approximately 20% to approximately 40% of said overall height of said container below said center of gravity of said container.

* * * * *

UNITED STATES PATENT AND TRADEMARK OFFICE

CERTIFICATE OF CORRECTION

PATENT NO. : 7,520,399 B2
APPLICATION NO. : 11/476444
DATED : April 21, 2009
INVENTOR(S) : Michael T. Lane et al.

It is certified that error appears in the above-identified patent and that said Letters Patent is hereby corrected as shown below:

| | |
|---|---|
| Column 2, line 39 | After “20%”, insert --crystallinity--. |
| Column 5, line 33 | “seal-the” should be --seal the--. |
| Column 9, line 64 | “the dimension” should be --the depth dimension--. |

Signed and Sealed this

Fourth Day of August, 2009

JOHN DOLL
*Acting Director of the United States Patent and Trademark Office*